US007239296B2

(12) United States Patent
Cheng et al.

(10) Patent No.: US 7,239,296 B2
(45) Date of Patent: Jul. 3, 2007

(54) CIRCUIT FOR DRIVING PIXELS OF AN ORGANIC LIGHT EMITTING DISPLAY

(75) Inventors: Jung-Chieh Cheng, Changhua County (TW); Tai-Ming Lin, Taipei (TW); I-Cheng Shih, Taoyuan County (TW)

(73) Assignee: Chunghwa Picture Tubes, Ltd., Taipei (TW)

( * ) Notice: Subject to any disclaimer, the term of this patent is extended or adjusted under 35 U.S.C. 154(b) by 71 days.

(21) Appl. No.: 11/161,130

(22) Filed: Jul. 25, 2005

(65) Prior Publication Data

US 2007/0018925 A1 Jan. 25, 2007

(51) Int. Cl.
*G09G 3/32* (2006.01)

(52) U.S. Cl. ..... 345/82; 345/92; 345/91; 345/76

(58) Field of Classification Search ..... 345/90–92, 345/82–84, 87, 88, 76, 77; 315/169.3, 169.4
See application file for complete search history.

(56) References Cited

U.S. PATENT DOCUMENTS

| | | | | |
|---|---|---|---|---|
| 7,129,524 | B2 * | 10/2006 | Lee | 257/59 |
| 2003/0016196 | A1 * | 1/2003 | Lueder et al. | 345/82 |
| 2006/0145960 | A1 * | 7/2006 | Koga et al. | 345/76 |

OTHER PUBLICATIONS

Article titled "A Simple and Effective ac Pixel Driving Circuit for Active Matrix OLED" offered by Yujuan et al. In *IEEE Transactions On Electron Devices*, vol. 50, No. 4, pp. 1137-1140, Apr. 2003.
Article titled "Improvement of Current-Voltage Characteristics in Organic Light Emitting Diodes by Application of Reversed-Bias Voltage" published by Zou et al. in *Japanese Journal of Applied Physics*, vol. 37, pp. 1406-1408, Nov. 1998.
Article titled "A 2.5-Inch OLED Display with a Three-TFT Pixel Circuit for Clamped Inverter Driving" published by Kageyama et al. in *SID 04 Digest*, pp. 1394-1397, 2004.

* cited by examiner

*Primary Examiner*—Tuyet Thi Vo
(74) *Attorney, Agent, or Firm*—Jianq Chyun IP Office

(57) ABSTRACT

A circuit and a method for driving pixels of an organic light-emitting display are provided. The circuit comprises a thin-film transistor having a source terminal connected to a voltage source, a storage capacitor having a first terminal connected to a gate terminal of the thin-film transistor, and an organic light-emitting diode having a cathode connected to a ground. The gate terminal and a drain terminal of the thin-film transistor are connected in a clamping phase and a reverse phase. A second terminal of the storage capacitor is connected to the ground in the clamping phase, and is connected to a data line in a light-emitting phase and in the reverse phase. An anode of the organic light-emitting diode is connected to the drain terminal of the thin-film transistor in the light-emitting phase and in the reverse phase.

14 Claims, 7 Drawing Sheets

CIRCUIT FOR DRIVING PIXELS OF AN ORGANIC LIGHT EMITTING DISPLAY

BACKGROUND OF THE INVENTION

1. Field of the Invention

The present invention relates to a circuit and a method for driving an organic light emitting display. More particularly, the present invention relates to a circuit and a method for driving pixels of an organic light emitting display.

2. Description of the Related Art

Organic light-emitting displays based on organic light-emitting diodes have many advantages, such as spontaneous light emission, high luminance, high contrast, wide viewing angle and fast response. Therefore, scientists and engineers have been making a lot of effort on research and development of characteristics of and driving circuits for organic light-emitting displays. However, although organic light-emitting displays have the advantages mentioned above, there are still some problems waiting to be solved.

FIG. 1 depicts a basic circuit for driving the organic light-emitting diode OLED that is part of a pixel of an organic light-emitting display. When the thin-film transistor (TFT) T2 connected to the scan line SL is turned on, a data voltage is stored into the storage capacitor Cs. And then the data voltage stored in the storage capacitor Cs determines the current passing through the TFT T1, and thereby determines the brightness of the organic light-emitting diode OLED. This driving circuit is simple. However, it has some problems such as threshold voltage shift and shortened material lifetime of organic light-emitting diodes.

Drifting threshold voltage means that the threshold voltages of driving switches tend to vary because of factors such as time and fabrication process. The current through organic light-emitting diodes also tends to vary according to the drifting. Consequently, the brightness of pixels of an organic light-emitting display is often discordant even when the pixels receive identical data signals. For solving this problem, the article by H. Kageyama et. al. and titled "A 2.5-inch OLED Display with a Three-TFT Pixel Circuit for Clamped Inverter Driving" (SID2004) proposed the circuit depicted in FIG. 2. The circuit in FIG. 2 clamps and stores the threshold voltage factor (VDD–$V_{th}$, where $V_{th}$ is the threshold voltage of the TFT T1) into the storage capacitor Cs by switching the TFT T2 and T3. Later, during the period with an external electric field of the organic light-emitting diode OLED, the voltage stored in the storage capacitor Cs will cancel out the threshold voltage of the TFT T1. In this way, the problem of discordant brightness caused by threshold voltage shift is solved.

About material lifetime of organic light-emitting diodes. The article by Dechun Zou et. al. and titled "Improvement of Current-Voltage Characteristics in Organic Light Emitting Diodes by Application of Reversed-Bias Voltage" (Japanese Journal of Applied Physics, vol. 37, pp. L1406–L1408, 1998) disclosed the polarization phenomenon induced during the period with an external electric field of organic light-emitting diodes. Please refer to FIG. 3 and FIG. 4. FIG. 3 shows the random distribution of ionic impurities inside an organic light-emitting diode during its period without an external electric field (that is, when the diode does not emit light), while FIG. 4 shows the distribution of the ionic impurities during the period with an external electric field of the diode. In the period with an external electric field, the external electric field E across the organic light-emitting diode separates positive charges and negative charges in the ionic impurities. Therefore the internal reverse electric field R is generated in response to the external electric field E. This is the polarization phenomenon. The polarization phenomenon not only shortens material lifetime of organic light-emitting diodes, but also hinders the movement of electrons and holes inside the diodes and reduces the light-emitting efficiency of the diodes.

Against the polarization phenomenon, the article by Si Yujuan et. al. and titled "A Simple and Effective AC Pixel Driving Circuit for Active Matrix OLED" (IEEE Transactions on Electron Devices, vol. 50, issue 4, pp. 1137–1141, April 2003) proposed the circuit depicted in FIG. 5. The voltage source Vref in FIG. 5 switches between 0V and a high voltage so that the organic light-emitting diode OLED is reverse-biased periodically. The reverse bias serves to join the separated positive and negative charges to eliminate the polarization phenomenon. Therefore the circuit in FIG. 5 is capable of prolonging the material lifetime of organic light-emitting diodes and enhancing the movement of electrons and holes inside the diodes.

As can be seen from the above, so far the prior art can solve only one of the polarization phenomenon and the problem of threshold voltage shift. One of the goals of the present invention is solving the polarization phenomenon and the problem of threshold voltage shift at the same time.

SUMMARY OF THE INVENTION

Accordingly, the present invention is directed to a circuit for driving pixels of an organic light-emitting display. The circuit is able to solve the problem of discordant brightness caused by threshold voltage shift. The circuit is also capable of solving the problem of polarization to prolong the material lifetime of organic light-emitting diode and to enhance the movement of electrons and holes.

The present invention is also directed to a method for driving pixels of an organic light-emitting display. The method advances the clamping of the threshold voltage of the driving switch so that the timing control of the switches in the pixel driving circuit can be relaxed.

According to an embodiment of the present invention, a circuit for driving pixels of an organic light-emitting display is provided. The circuit comprises a thin-film transistor having a source terminal connected to a voltage source, a storage capacitor having a first terminal connected to a gate terminal of the thin-film transistor, and an organic light-emitting diode having a cathode connected to a ground. When the circuit is in a clamping phase, the gate terminal of the thin-film transistor is connected to a drain terminal of the thin-film transistor and a second terminal of the storage capacitor is connected to the ground. When the circuit is in a light-emitting phase, the second terminal of the storage capacitor is connected to a data line and an anode of the organic light-emitting diode is connected to the drain terminal of the thin-film transistor. Finally, when the circuit is in a reverse phase, the gate terminal of the thin-film transistor is connected to the drain terminal of the thin-film transistor, the second terminal of the storage capacitor is connected to the data line, and the anode of the organic light-emitting diode is connected to the drain terminal of the thin-film transistor.

In an embodiment of the present invention, when the circuit is in the light-emitting phase, the circuit receives a data voltage and a reference voltage from the data line. Moreover, the data voltage and the reference voltage determine a conducting time of the thin-film transistor.

In an embodiment of the present invention, the reference voltage is a triangular voltage signal.

In an embodiment of the present invention, when the circuit is in the reverse phase, the circuit receives a negative voltage from the data line.

According to another embodiment of the present invention, a method for driving pixels of an organic light-emitting display is provided. The method is characterized by storing a threshold voltage of a thin-film transistor in a storage capacitor before a switch connected to a scan line is turned on.

In an embodiment of the present invention, the thin-film transistor drives an organic light-emitting diode.

In an embodiment of the present invention, the method further comprises the step of determining a conducting time of the thin-film transistor according to a data voltage and a reference voltage.

In an embodiment of the present invention, the method further comprises the step of applying a reverse bias across the organic light-emitting diode during a period without an external electric field of the organic light-emitting diode.

The present invention solves the problem of discordant brightness by storing the threshold voltage of the driving switch in a storage capacitor to cancel out the threshold voltage itself. The present invention also uses reverse bias to eliminate the polarization phenomenon to prolong the material lifetime of organic light-emitting diode and to enhance the movement of electrons and holes. Besides, the present invention advances the clamping of the threshold voltage of the driving switch without occupying the light emitting period of the organic light-emitting diode. Therefore the timing control of the switches in the pixel driving circuit can be relaxed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
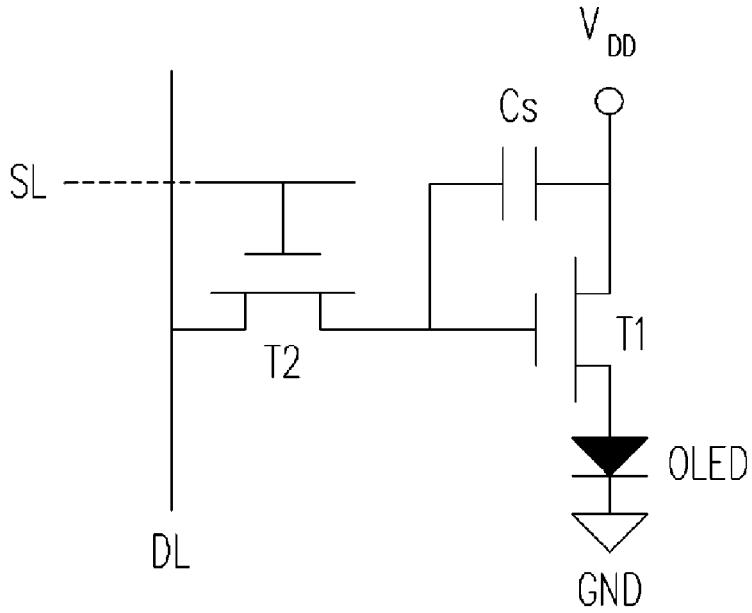
FIG. 1 (PRIOR ART)
FIG. 1 and FIG. 2 are schematic diagrams showing prior art circuits for driving pixels of an organic light-emitting display.
Figure 2:
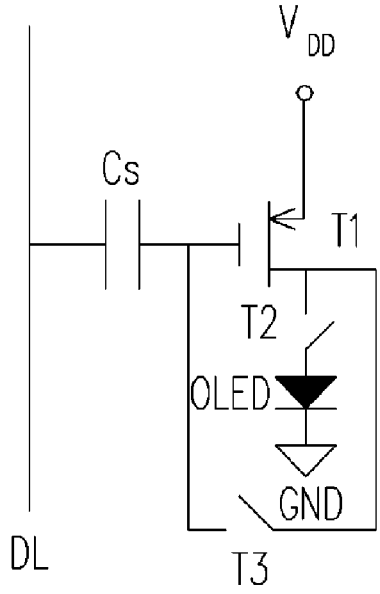
FIG. 2 (PRIOR ART)
Figure 3:
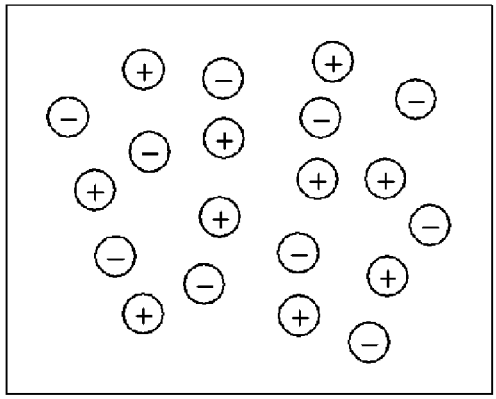
FIG. 3 and FIG. 4 are schematic diagrams showing the polarization phenomenon in an organic light-emitting diode.
Figure 4:
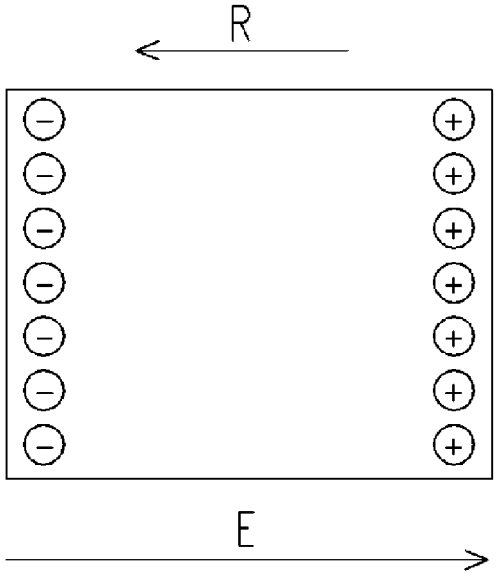
Figure 5:
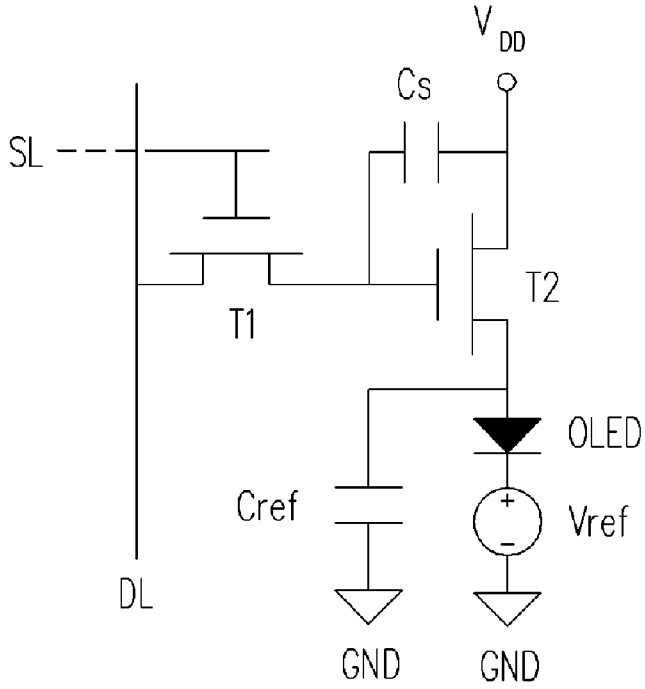
FIG. 5 (PRIOR ART)
FIG. 5 is a schematic diagram showing a prior art circuit for driving pixels of an organic light-emitting display.

Reference will now be made in detail to the present preferred embodiments of the invention, examples of which are illustrated in the accompanying drawings. Wherever possible, the same reference numbers are used in the drawings and the description to refer to the same or like parts.

Figure 6:
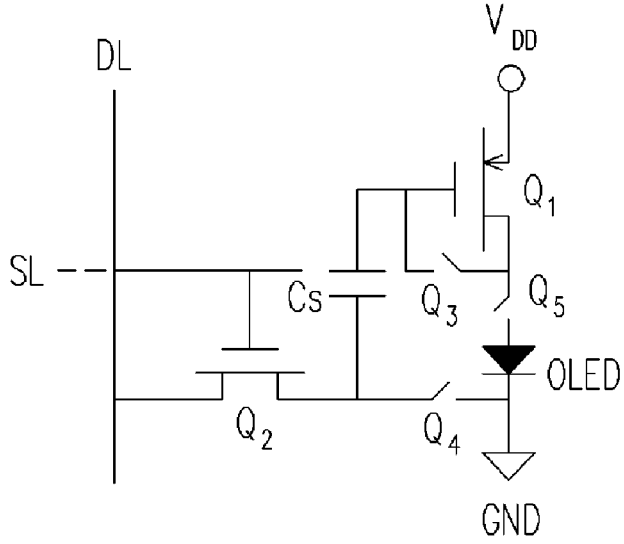
FIG. 6 is a schematic diagram showing a circuit for driving pixels of an organic light-emitting display according to an embodiment of the present invention.

FIG. 6 is a schematic diagram showing a circuit for driving pixels of an organic light-emitting display according to an embodiment of the present invention. The circuit in this embodiment comprises the thin-film transistor $Q_1$~$Q_5$, the storage capacitor Cs, and the organic light-emitting diode OLED. The thin-film transistor $Q_1$ has a source terminal connected to the voltage source $V_{DD}$ and a gate terminal connected to the first terminal of the storage capacitor Cs. The cathode of the organic light-emitting diode OLED is connected to the ground GND. The TFT $Q_2$ connects or disconnects the second terminal of the storage capacitor Cs and the data line DL in response to a signal received from the scan line SL. The TFT $Q_3$ is connected between the gate terminal and the drain terminal of the thin-film transistor $Q_1$. The TFT $Q_4$ is connected between the second terminal of the storage capacitor Cs and the ground GND. The TFT $Q_5$ is connected between the drain terminal of the thin-film transistor Q1 and the anode of the organic light-emitting diode OLED. In this embodiment, the TFT Q1 is also known as the driving switch, because $Q_1$ drives the organic light-emitting diode OLED.

Figure 7:
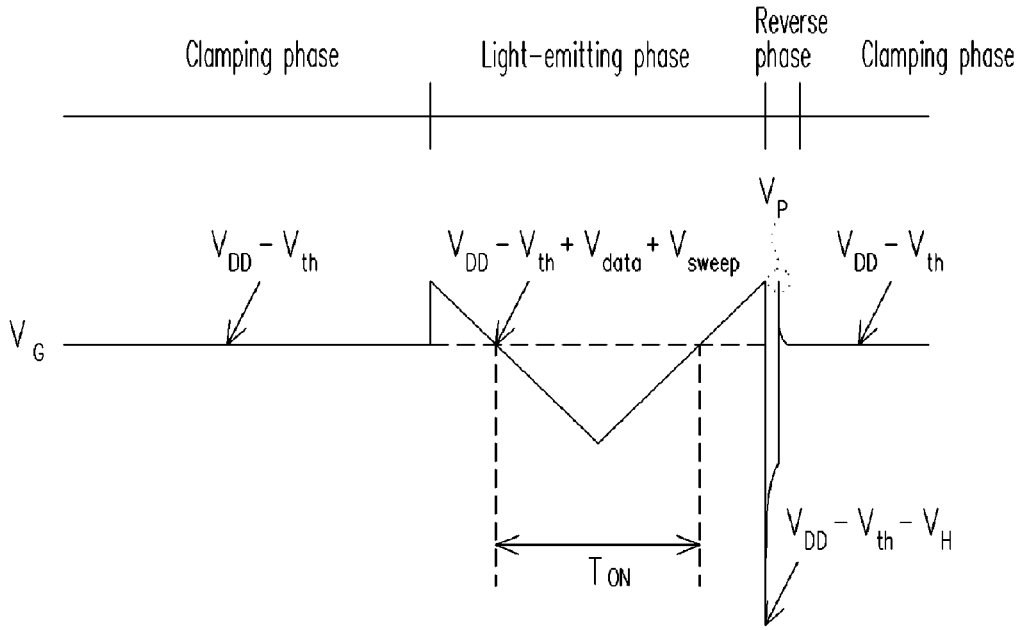
FIG. 7 is a schematic diagram showing the variation of the voltage at the gate terminal of the driving switch in a circuit for driving pixels of an organic light-emitting display according to an embodiment of the present invention.

In this embodiment, the operation of the circuit in FIG. 6 is divided into three phases. They are the clamping phase, the light-emitting phase, and the reverse phase. The light-emitting phase follows the clamping phase. The reverse phase follows the light-emitting phase. And the clamping phase follows the reverse phase. The three phases form a continuous cycle. FIG. 7 shows the variation of the voltage VG at the gate terminal of the driving switch $Q_1$ of the circuit in FIG. 6 in the three operating phases. The details are discussed below.

Figure 8:
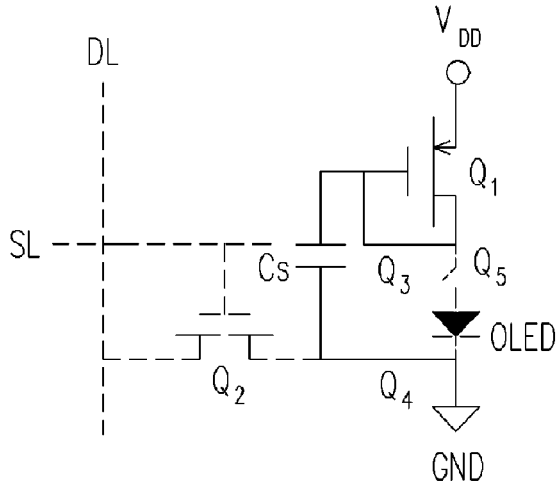
FIG. 8 is a schematic diagram showing the operation of a circuit for driving pixels of an organic light-emitting display according to an embodiment of the present invention.
Figure 9:
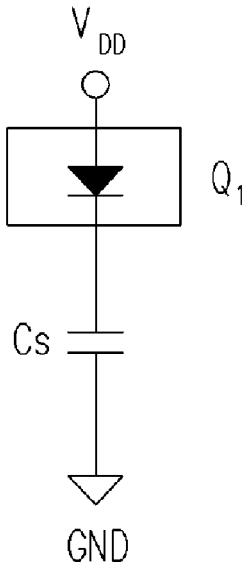
FIG. 9 is a schematic diagram showing an equivalent of a circuit for driving pixels of an organic light-emitting display according to an embodiment of the present invention.

In the clamping phase, the thin-film transistors $Q_1$, $Q_3$ and $Q_4$ are turned on, whereas $Q_2$ and $Q_5$ are turned off. Therefore the gate terminal and the drain terminal of the thin-film transistor $Q_1$ are connected together. And the second terminal of the storage capacitor Cs is connected to the ground GND. The connection of the above components in the clamping phase is shown in solid lines in FIG. 8. The driving switch Q1 in the clamping phase is equivalent to a diode and the circuit in FIG. 8 is equivalent to the circuit depicted in FIG. 9. The voltage across the diode $Q_1$ is the threshold voltage $V_{th}$ of the thin-film transistor $Q_1$. The voltage across the storage capacitor Cs is equal to ($VDD-V_{th}$), and is equal to the voltage VG at the gate terminal of the thin-film transistor $Q_1$, as depicted in FIG. 7. At this moment, the threshold voltage factor $VDD-V_{th}$ has been clamped and stored in the storage capacitor Cs.

Figure 10:
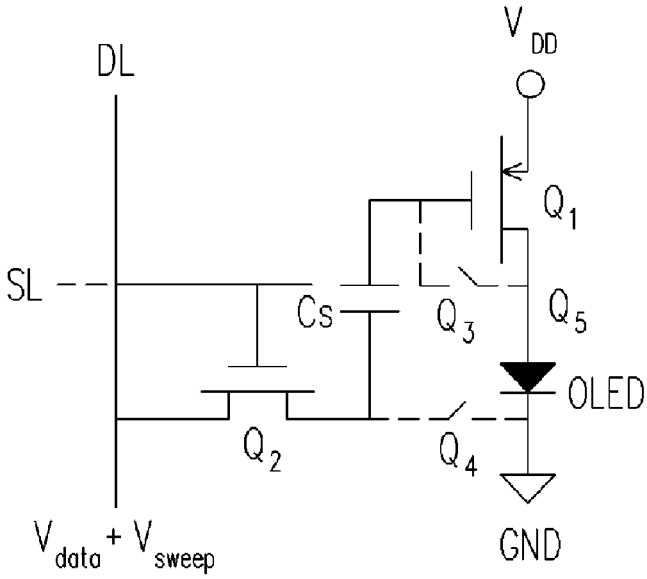
FIG. 10 and FIG. 11 are schematic diagrams showing the operation of a circuit for driving pixels of an organic light-emitting display according to an embodiment of the present invention.

In the light-emitting phase, the thin-film transistors $Q_1$, $Q_2$ and $Q_5$ are turned on, whereas $Q_3$ and $Q_4$ are turned off. Therefore the second terminal of the storage capacitor Cs is connected to the data line DL and the anode of the organic light-emitting diode OLED is connected to the drain terminal of the thin-film transistor $Q_1$. The connection of the above components is shown in solid lines in FIG. 10. In the light-emitting phase, the data voltage $V_{data}$ and the reference voltage $V_{sweep}$ are provided to the data line DL, raising the voltage $V_G$ at the gate terminal of $Q_1$ to $(V_{DD}-V_{th}+V_{data}+V_{sweep})$, as depicted in FIG. 7. To turn on the driving switch $Q_1$, the inequality $V_{DD}-V_G>V_{th}$ must be satisfied. In other words, the inequality $V_{DD}-(V_{DD}-V_{th}+V_{data}+V_{sweep})>V_{th}$ must be satisfied. It can be easily deduced that to turn on the driving switch $Q_1$ and to have the organic light-emitting diode OLED emit light, the voltages mentioned above have to satisfy the inequality $(V_{data}+V_{sweep})<0$. Please note that the threshold voltage $V_{th}$ does not appear in the last inequality. Thanks to the voltage clamping, the threshold voltage $V_{th}$ of the driving switch $Q_1$ appears on both sides of the inequality and cancels out itself. Therefore the problem caused by the threshold voltage shift $V_{th}$ is solved.

As shown in the above discussions, the length of the conducting time of the thin-film transistor $Q_1$ and the light emitting period of the organic light-emitting diode OLED is determined by the data voltage $V_{data}$ and the reference voltage $V_{sweep}$. As shown in FIG. 7, in this embodiment, the data voltage $V_{data}$ is a DC (direct current) voltage, while the reference voltage $V_{sweep}$ is a fixed triangular voltage signal. When the inequality $(V_{data}+V_{sweep})<0$ is satisfied, the voltage $V_G$ is smaller than $V_{DD}-V_{th}$. Therefore the period Ton in FIG. 7 is when the organic light-emitting diode OLED emits light. In this embodiment, the waveform of the reference voltage $V_{sweep}$ is fixed, and the data voltage $V_{data}$ varies with pixel data in order to control the length of the period Ton, in which the organic light-emitting diode OLED emits light, and thereby control the brightness of the diode OLED.

Figure 11:
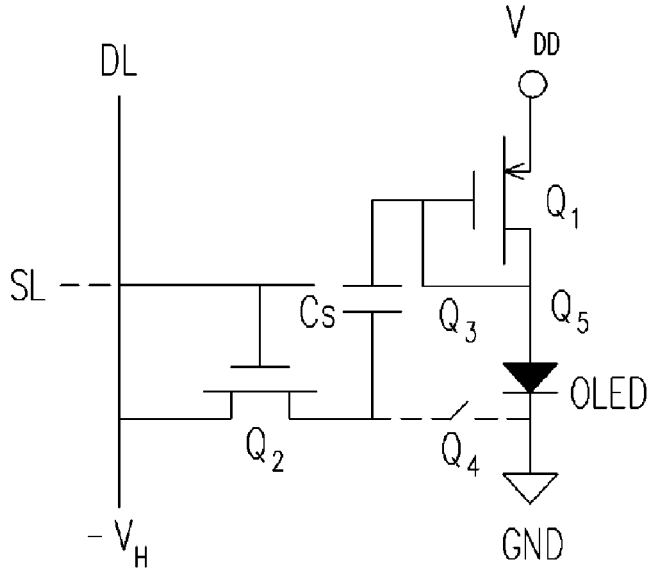
Figure 12:
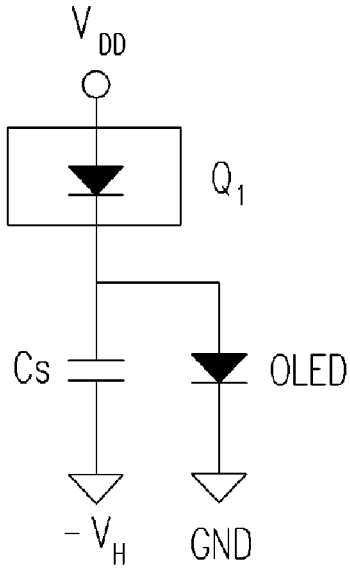
FIG. 12 is a schematic diagram showing an equivalent of a circuit for driving pixels of an organic light-emitting display according to an embodiment of the present invention.

In the reverse phase, the thin-film transistors $Q_1$, $Q_2$, $Q_3$ and $Q_5$ are turned on, whereas $Q_4$ is turned off. Therefore, the gate terminal and the drain terminal of the thin-film transistor Q1 are connected together, the second terminal of the storage capacitor Cs is connected to the data line DL, the anode of the organic light-emitting diode OLED is connected to the drain terminal of the thin-film transistor $Q_1$. The connection of the above components is shown in solid lines in FIG. 11. Because the TFT $Q_3$ is turned on, the driving switch $Q_1$ is equivalent to a diode, and the circuit in this embodiment is equivalent to the circuit depicted in FIG. 12. In the reverse phase, the negative voltage −VH is provided to the data line DL, lowering the gate voltage $V_G$ at the gate terminal of $Q_1$ to $V_{DD}-V_{th}-V_H$, as shown in FIG. 7. The negative voltage $-V_H$ is negative enough to satisfy the inequality $V_H>V_{DD}-V_{th}$. In other words, the gate voltage $V_G$ will be lower than 0V and there will be a reverse bias across the organic light-emitting diode OLED to eliminate the polarization phenomenon.

Figure 13:
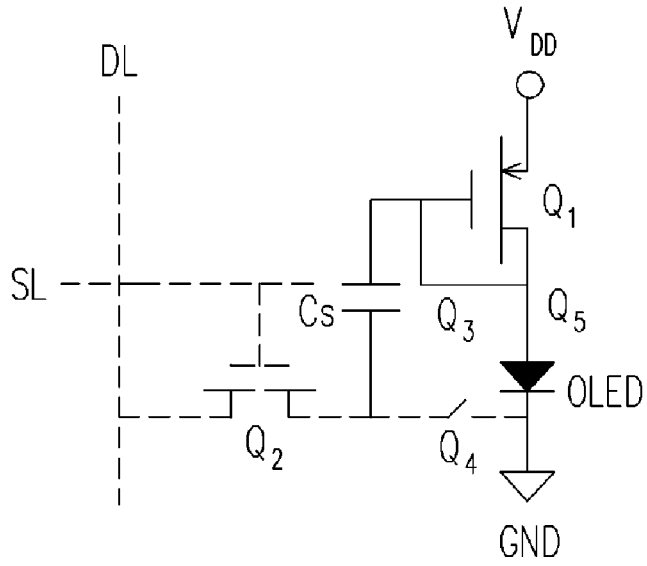
FIG. 13 and FIG. 14 are schematic diagrams showing the operation of a circuit for driving pixels of an organic light-emitting display according to an embodiment of the present invention.
Figure 14:
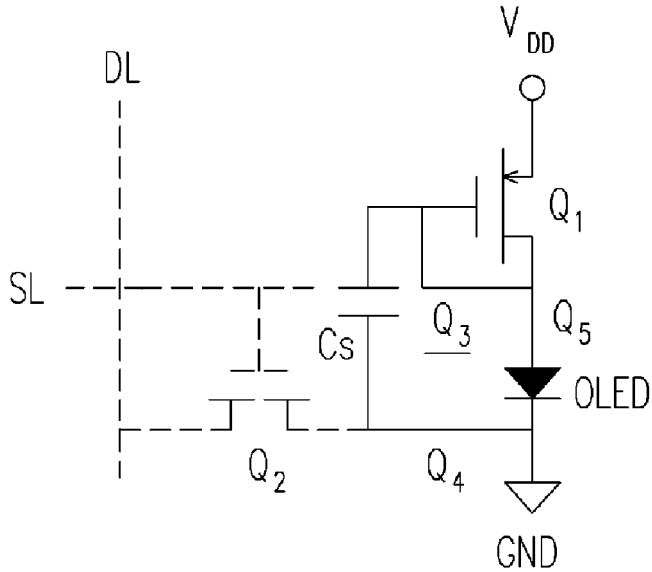

As shown in FIG. 7, the gate voltage VG falls to VDD−Vth−VH at first, and then the gate voltage VG rises towards 0V due to the charging of the storage capacitor Cs. If the gate voltage VG rises to 0V or gets higher, the organic light-emitting diode OLED will be turned on and start to emit light. To avoid this problem, the driving circuit in this embodiment has to enter the clamping phase again before the gate voltage VG rises to 0V. There are two transient steps before the circuit enters the clamping phase again. The first step is turning off the TFT Q2 to remove the negative voltage −VH. The connection of the components of the circuit after the first step is shown in solid lines in FIG. 13. The second step is turning on the TFT Q4. The connection after the second step is shown in solid lines in FIG. 14. At this moment, the gate voltage VG will rises to the point VP in FIG. 7, generating a reverse bias to turn off the driving switch Q1. At the same time, the organic light-emitting diode OLED provides a path for the storage capacitor Cs to discharge. Although the organic light-emitting diode OLED does emit light in this short moment, the duration is too short to affect its overall brightness. When the voltage across the storage capacitor Cs lowers to VDD−Vth to turn on the driving switch Q1, the TFT Q5 is turned off and the driving circuit in this embodiment is back into the clamping phase.

The present invention also comprehends a method for driving pixels of an organic light-emitting display. The main steps of the method include storing the threshold voltage $V_{th}$ of the thin-film transistor $Q_1$ in the storage capacitor Cs before the TFT $Q_2$ connected to the scan line SL is turned on, determining the conducting time of the thin-film transistor $Q_1$ according to the data voltage $V_{data}$ and the reference voltage $V_{sweep}$, and applying a reverse bias across the organic light-emitting diode OLED during a period without an external electric field of the organic light-emitting diode OLED. The details of the method are not described here because anyone skilled in the related art should be able to implement the method easily after referring to the above embodiments of the present invention.

As can be seen in the above embodiments, the present invention stores the threshold voltage of the driving switch in a storage capacitor such that the threshold voltage will cancel out itself, therefore eliminating the problem of discordant brightness caused by threshold voltage shifts. Besides, the present invention applies reverse bias to eliminate the polarization phenomenon. Consequently the material lifetime of organic light-emitting diodes is prolonged and the movement of electrons and holes inside the diodes is enhanced. Furthermore, the present invention advances the clamping of the threshold voltage of the driving switch. The period with an external electric field of organic light-emitting diodes is not occupied by the clamping. Therefore the timing control of the TFT in the driving circuit can be relaxed.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A circuit for driving pixels of an organic light-emitting display, comprising:

a thin-film transistor having a source terminal connected to a voltage source;

a storage capacitor having a first terminal connected to a gate terminal of the thin-film transistor; and an organic light-emitting diode having a cathode grounded; wherein when in a clamping phase, the gate terminal of the thin-film transistor is connected to a drain terminal of the thin-film transistor and a second terminal of the storage capacitor is grounded;

when in a light-emitting phase, the second terminal of the storage capacitor is connected to a data line and an anode of the organic light-emitting diode is connected to the drain terminal of the thin-film transistor;

when in a reverse phase, the gate terminal of the thin-film transistor is connected to the drain terminal of the thin-film transistor, the second terminal of the storage capacitor is connected to the data line, and the anode of the organic light-emitting diode is connected to the drain terminal of the thin-film transistor.

2. The circuit of claim 1, wherein in the reverse phase, the circuit receives a negative voltage from the data line.

3. The circuit of claim 1, wherein the clamping phase, the light-emitting phase, and the reverse phase are concatenated in the cyclic order above.

4. The circuit of claim 1, farther comprising:

a switch, positioned between the gate terminal and the drain terminal of the thin-film transistor, connecting or disconnecting the second terminal of the storage capacitor and the data line in response to a signal received from a scan line.

5. The circuit of claim 4, wherein the switch is turned on in the light-emitting phase or in the reverse phase.

6. The circuit of claim 1, further comprising:

a switch positioned between the drain terminal of the thin-film transistor and the anode of the organic light-emitting diode.

7. The circuit of claim 6, wherein the switch is turned on in the light-emitting phase and in the reverse phase.

8. The circuit of claim 1, wherein in the light-emitting phase, the circuit receives a data voltage and a reference voltage from the data line, and the voltages above determine a conducting time of the thin-film transistor.

9. The circuit of claim 8, wherein the reference voltage is a triangular voltage signal.

10. The circuit of claim 1, further comprising:

a first switch connected to the second terminal of the storage capacitor and is grounded.

11. The circuit of claim 10, wherein the first switch is turned on in the clamping phase.

12. The circuit of claim 11, further comprising:

a second switch, connecting or disconnecting the second terminal of the storage capacitor and the data line in response to a signal received from a scan line.

13. The circuit of claim 12, wherein the second switch is turned on in the light-emitting phase and in the reverse phase.

14. The circuit of claim 13, wherein when leaving the reverse phase and entering the clamping phase, the second switch is turned off and then the first switch is turned on.

* * * * *